US005584566A

United States Patent [19]

Bowman et al.

[11] Patent Number: 5,584,566

[45] Date of Patent: Dec. 17, 1996

[54] BACKLIGHTING LIGHT FIXTURES FOR TRADE SHOW DISPLAY STRUCTURES

[75] Inventors: William K. Bowman, Thousand Oaks; Victor E. Carlson, Westlake Village, both of Calif.

[73] Assignee: R. C. Dudek & Company, Inc., Oxnard, Calif.

[21] Appl. No.: 503,335

[22] Filed: Jul. 17, 1995

[51] Int. Cl.[6] ..... F21V 21/34

[52] U.S. Cl. ..... 362/220; 362/225; 362/238; 362/242; 362/212; 362/320; 40/573; 40/605

[58] Field of Search ..... 362/226, 260, 362/320, 125, 222, 219, 220, 223, 224, 225, 238, 239, 240, 241, 812, 249, 310, 346, 367, 374, 375; 40/573, 564, 575, 576, 605

[56] References Cited

U.S. PATENT DOCUMENTS

| | | | |
|---|---|---|---|
| 2,643,328 | 6/1953 | Elmendorf | 362/224 |
| 2,928,198 | 3/1960 | Madanick | 40/576 |
| 3,838,266 | 9/1974 | Johnathan | 362/224 |
| 4,602,448 | 7/1986 | Grove | 40/605 |
| 5,276,598 | 1/1994 | Hedenstrom et al. | 362/238 |
| 5,379,540 | 1/1995 | Howard | 40/605 |

*Primary Examiner*—Ira S. Lazarus
*Assistant Examiner*—Thomas M. Sember
*Attorney, Agent, or Firm*—Drucker & Sommers

[57] ABSTRACT

A backlighting light fixture adapted for use in providing backlight illumination for display structures having a framework made of rail members assembled to define openings, with translucent, image bearing panels mounted in the openings. The backlighting light fixture has a reflector and lamp support portion is made of a resilient and flexible material, having an inside surface, an outside surface, and opposing side edges and top and bottom edges. A first attachment portion is attached to an inside surface of the reflector and lamp support portion. A light source is also provided, with a second attachment portion fixed thereto. The first and second attachment portions are detachably attachable together so that the light source can be detachably affixed to the inside surface of the reflector and lamp support portion. The backlighting light fixture is detachably engageable with the display structure by rearwardly bowing the outside surface of the reflector and lamp support portion carrying the light source, and engaging its side edges with the display structures so that the reflector and lamp support portion and its carried light source are securely retained in the area of the opening.

17 Claims, 4 Drawing Sheets

Fig. 4a
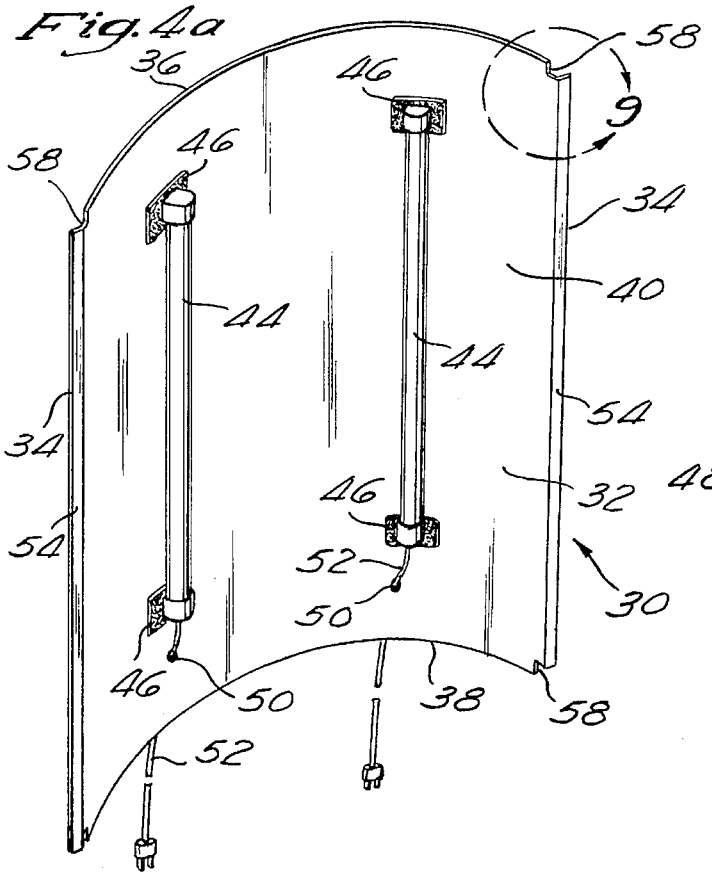
Fig. 5
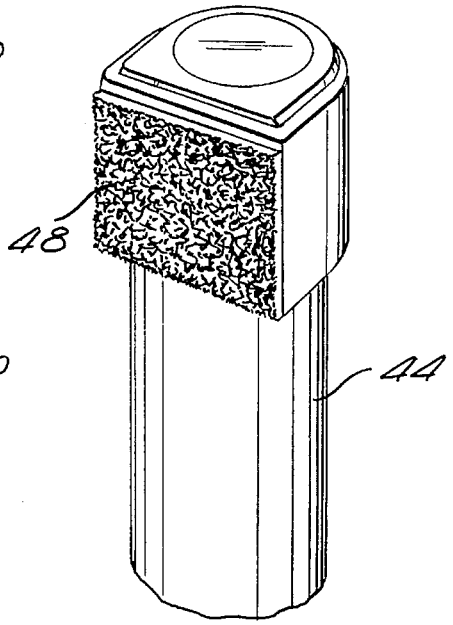
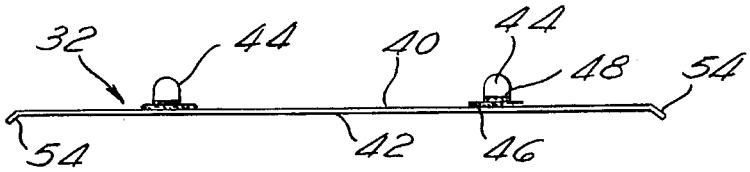
Fig. 4b
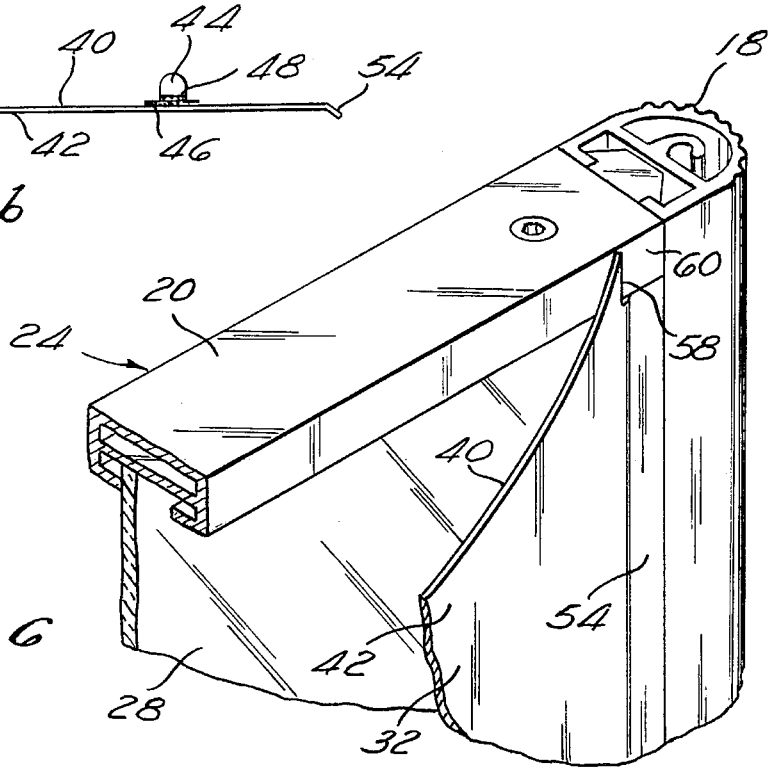
Fig. 6

BACKLIGHTING LIGHT FIXTURES FOR TRADE SHOW DISPLAY STRUCTURES

BACKGROUND OF THE INVENTION

1. Field of the Invention

This invention relates to the field of lighting fixtures, and more particularly to a backlighting light fixture adapted for use in the backlighting of image bearing panels of trade show, point of purchase display, graphic advertisement stands for various products, such as cosmetics, and also for light tables.

2. Description of the Prior Art

Trade shows provide an ideal venue for participants to display their goods and services to others in the industry, potential customers, and members of the general public. At any given time, there are literally tens of hundreds of trade shows going on around the country and world. The business of providing and setting up the various trade show display structures and equipment has, in its own right, created many new business opportunities. However, the high costs associated with purchasing, maintaining, transporting, storing, and setting up and taking down trade show display structures are an ongoing source of concern. Those in the industry of manufacturing trade show display structures are continually searching for new ways to improve their trade show display structures to make them less expensive to manufacture and maintain, more compact to store and ship, lighter in weight, and quicker and easier to set up and take down.

One popular style of display structure utilizes numerous modular panel sections which can be quickly and easily joined together into a number of customizable structures to suit the end-user's needs, and when not used, broken down for compact and lightweight storage and shipping. The modular panel sections have a frame structure assembled from rail sections, with openings formed between the rails. The openings are typically occupied by opaque, transparent or translucent panels, depending on how the panels will be used. In some of these systems, spot lights are placed in front of the trade show display structures and are used to illuminate the graphics and images on the panels.

Other systems utilize backlighting to illuminate images which have been placed on transparent or translucent panels by printing, silkscreening or laminating. In the trade show display stand industry, images are printed on a light-diffusing film, which is then laminated to a sheet of plastic, such as PLEXIGLAS®. The light diffusing film is used to prevent the outline of the light source positioned behind the panels, i.e. fluorescent lamps, from being too noticeable. The image bearing light-diffusing film is then overlaid with a transparent protective layer or film. These image bearing panels can be backlit with a lightbox which is affixed to the frame behind the image bearing panels. These backlit panels have an attractive look and impact, and are popular. However, these types of panels are somewhat expensive.

Presently, the prior art backlighting lightboxes consist of relatively heavy (10 to 20 lbs), deep (six to eight inches), and expensive sheet metal or aluminum boxes into which light fixtures, i.e. fluorescent lamps or incandescent bulbs, are permanently mounted. These lightboxes are then mounted with clips, screws or bolts to the back of the panels to be backlit. These lightboxes cannot be broken down into flatter structures for storage and shipping, and because of their weight, are more difficult to handle during the assembly of the display structures. Also, since these prior art lightboxes have a substantial depth, it is not possible to use them to build columns with backlit panels on all four sides. There accordingly remains a need for a backlighting light fixture for trade show and presentation display structures which are low in cost, lightweight, relatively compact, easy to assemble and disassemble, and cost effective to store and ship.

BRIEF SUMMARY OF THE INVENTION

One object of the invention is to provide backlighting light fixtures for trade show display structures which are lightweight and inexpensive.

Another object of the invention is to provide backlighting light fixtures for trade show display structures which are easy to install and uninstall.

Yet another object of the invention is to provide backlighting light fixtures for trade show display structures whose light bulbs are easy to replace.

Still yet a further objective of the invention is to provide backlighting light fixtures for trade show display structures which contribute to the overall structural integrity of the trade show display structure.

Still yet another objective of the invention is to provide a backlighting light fixture for trade show display structures which can be used to build structure having even lighting, including corners, and which can be used to build lighted columns and other structures.

A further objective of the invention is to provide a backlighting light fixture which can be used for horizontal, backlit light tables, particularly lightweight, portable light tables for use in viewing prints and the like.

These and other objects of the invention are accomplished by providing a backlighting light fixture adapted for use in providing backlight illumination for display structures having a framework comprising rail members assembled to define openings, with translucent panels mounted in the openings, said backlighting light fixture comprising:

a reflector and lamp support portion comprising resilient and flexible material, having an inside surface, an outside surface, and opposing side edges and top and bottom edges;

first attachment means fixed to said inside surface of said reflector and lamp support portion;

at least one light source;

a second attachment means fixed to said at least one light source, said first and second attachment means being detachably attachable together so that said at least one light source detachably affixes to said inside surface of said reflector and lamp support portion;

wherein said backlighting light fixture is detachably engageable with said display structure by rearwardly bowing the outside surface of said reflector and lamp support portion carrying said at least one light source, and engaging said side edges of said reflector and lamp support portion with the display structures so that said reflector and lamp support portion and its carried at least one light source are securely retained in the area of the opening.

The other objects of the invention are further accomplished by providing a backlighting light fixture adapted for use in providing backlight illumination for display structures, the display structures comprising a framework of side rail means and top and bottom rail means assembled to define openings, the rail means having channels formed along their inside regions, and translucent panels with a perimeter region, the panels being mountable within the openings of the framework by placing the perimeter region of the panels in the channels of the rail means, said backlighting light fixture comprising:

a reflector and lamp support portion comprising flexible and resilient material, having an inside surface, an outside surface, opposing side edges and top and bottom edges;

first attachment means fixed to said inside surface of said reflector and lamp support portion;

at least one light source;

a second attachment means fixed to said at least one light source, said first and second attachment means being detachably attachable together so that said at least one light source detachably affixes to said inside surface of said reflector and lamp support portion;

wherein said backlighting light fixture is detachably engageable with said display structure by bowing rearwardly the outside surface of said reflector and lamp support portion carrying said at least one light source, and engaging said side edges of said reflector and lamp support portion with the rail means so that said reflector and lamp support portion and its carried at least one light source are securely retained in the area of the opening.

BRIEF DESCRIPTION OF THE DRAWINGS

FIG. 4*a* is a front perspective view of a first embodiment of the backlighting light fixture of the invention.

FIG. 4*b* is a sectional view of the unbent reflector and lamp support portion of the backlighting light fixture of FIG. 4*a* carrying its light sources.

FIG. 5 is a detail showing the light source and its detachable attachment means for affixing the light source to the reflector and lamp support portion of the backlighting light fixture.

FIG. 6 is a vertical sectional view of the modular panel section and its affixed backlighting light fixture taken through view lines 6—6 of FIG. 2.

DETAILED DESCRIPTION OF THE INVENTION

Figure 1:
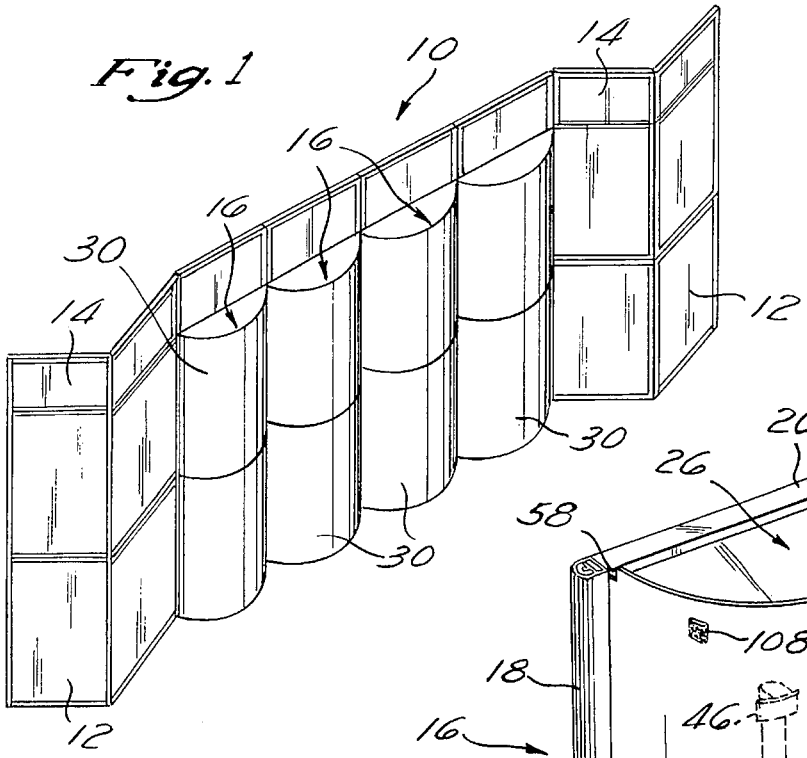
FIG. 1 is a rear perspective view of a trade show and presentation display structure which is assembled from modular panel sections.

Referring first to FIG. 1, a perspective view is shown of a trade show and presentation modular display structure 10, made up of various individual panel sections 12, 14, and 16 which are joined together to build a display structure having a desired size and configuration. The panels 12, 14, and 16 can be conveniently manufactured into a variety of sizes and shapes, such as rectangular sections, and can be used for displaying material in different ways. In FIG. 1, for example, the panels 12 and 14 can be used for displaying material which need not be backlit. The panels 16 are for use where backlighting of graphics placed on a front face is desired.

Figure 2:
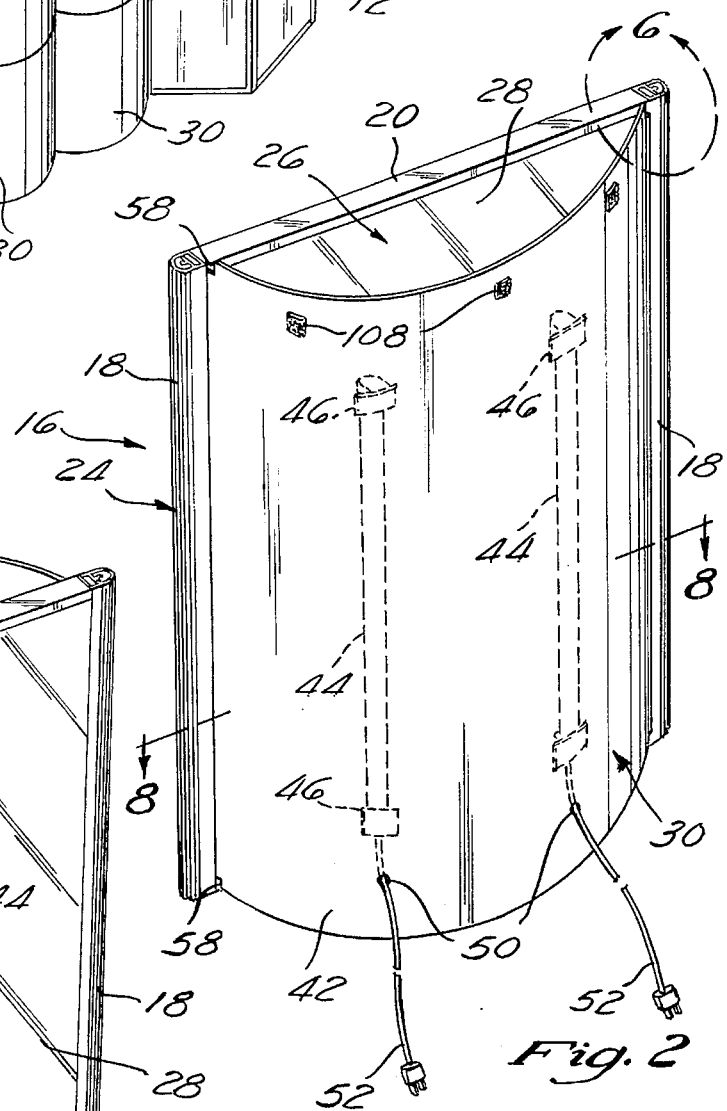
FIG. 2 is a rear perspective view of one modular panel section of the trade show and presentation display structure with a first embodiment of the backlighting light fixture of the invention affixed thereto.
Figure 3:
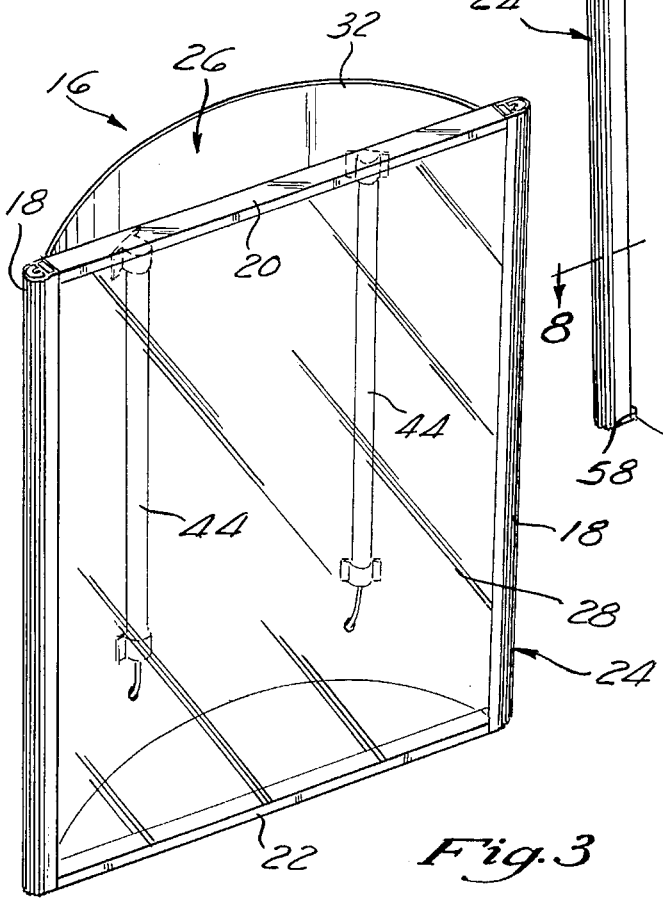
FIG. 3 is a front perspective view of a modular panel section and its backlighting light fixture of FIG. 2.

FIGS. 2 and 3 are perspective view of a single backlit panel section 16. Each panel section 16 has side rails 18, a top rail 20 and a bottom rail 22 which are joined together to define a framework 24 with an opening 26 between the rails. The opening 26 is filed with a panel of material 28. In the case of panels which are to be backlit, the material 28 is transparent or translucent, such as thermoplastic plastic materials, e.g. PLEXIGLAS®, upon which text, graphics and/or artwork to be illuminated are placed.

Figure 7:
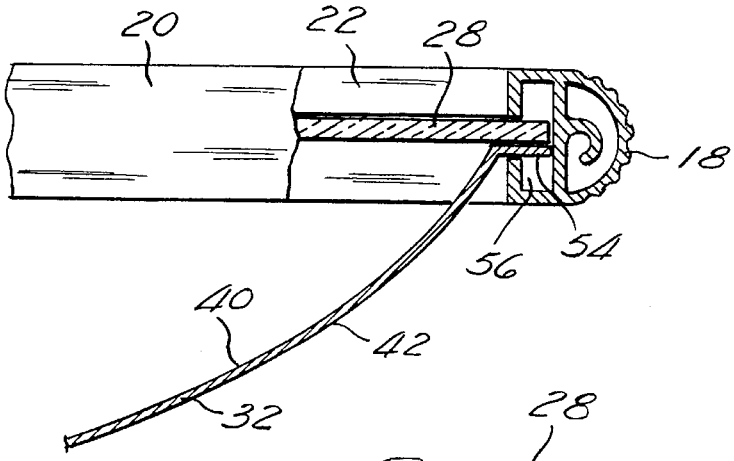
FIG. 7 is a detail of the circled area 7 of FIG. 2, showing how the backlighting light fixture is detachably attached to the modular panel section.

Referring to FIG. 4*a*, a rear perspective view of the backlighting light fixture 30 is shown. It utilizes a sheet of resilient and flexible material to form a reflector and lamp support portion 32. FIG. 4*b* is a cross-sectional view of the reflector and lamp support portion 32 in its unbowed state. The material is preferably opaque and reflects light well. The inventors have had good success in using 2 mm thick sheets of white expanded polyvinyl chloride, sold under the trade name SINTRA. SINTRA is lightweight yet strong, fire rated, easy to clean and maintain, readily cuttable to size, resilient and flexible, yet when heated will maintain any desired contours and bends. The reflector and lamp support portion 32 has side edges 34 and top and bottom edges, 36 and 38, respectively, and an inside surface 40 and an outside surface 42 (See FIG. 7.) At least one light source 44 is detachably yet securely positioned against the inside surface 40 of the reflector and lamp support portion 32. The inventors find that fluorescent lamps, such as the General Electric brand "Bright Stick" strip 33 watt fluorescent lamp, which has a single fluorescent lamp with an electronic ballast, all in a low profile strip package, can be detachably attached to the inside surface 40 of the reflector portion 32, and provide good, even lighting. This detachable attachment feature can be readily provided by affixing first detachable attachment means 46 to the inside surface 40 of the reflector and lamp support portion 32. A second complementary detachably detachment means 48 is affixed to portions the back of the light source 44, as is best shown in FIG. 5. In the preferred embodiment, patches of complementary hook and loop material 46 and 48, such as VELCRO®, are used to provide this detachable attachment feature. However, alternate means can be used to provide the detachable attachability. Preferably, at least one aperture 50 is formed through the reflector and lamp support portion 32 for passage of electrical power cords 52 of the light source 44.

Referring to FIGS. 4*a*, 4*b*, and 6–9, a first embodiment of the reflector and lamp support portion 32 is shown. In this embodiment, the sides 34 of the reflector and lamp support portion 32 are bent rearwardly at an angle to form lip regions 54. The angle of the bend is preferably set such that when the reflector and lamp support portion 32, normally a flat sheet (see FIG. 4*b*), is bowed rearwardly away from its two sides 34, the lip regions 54 will be oriented generally parallel to the plane of the panel of material 28, and will be slidable received in channels 56 in the side rails 18 of the framework 24. The resiliency of the sheet of material of the reflector and lamp support portion 32 naturally biases it back to its original, unbent and flat state. By bowing the reflector and lamp support portion 32 of the backlighting light fixture 32 rearwardly, and sliding the two lip regions 54 of the into channels 56 in the two side rails 18 of the framework 24, and allowing the reflector and lamp support portion 32 to spring back slightly, the backlighting light fixture 32 will be securely retained in contact with the framework 24, and will be positioned behind the image bearing panel 28. Removing the backlighting light fixture 32 is easily accomplished by pushing the sides 34 of the reflector and lamp support portion 32 inwardly.

Figure 9:
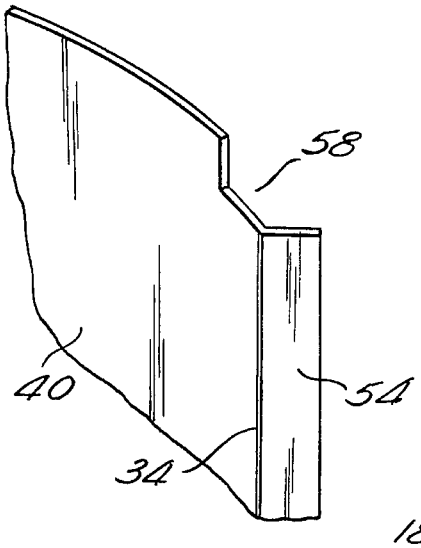
FIG. 9 is a detail showing the bent lip and notched corner of the reflector and lamp support portion in the circled area 9 of FIG. 4*a*.
Figure 11:
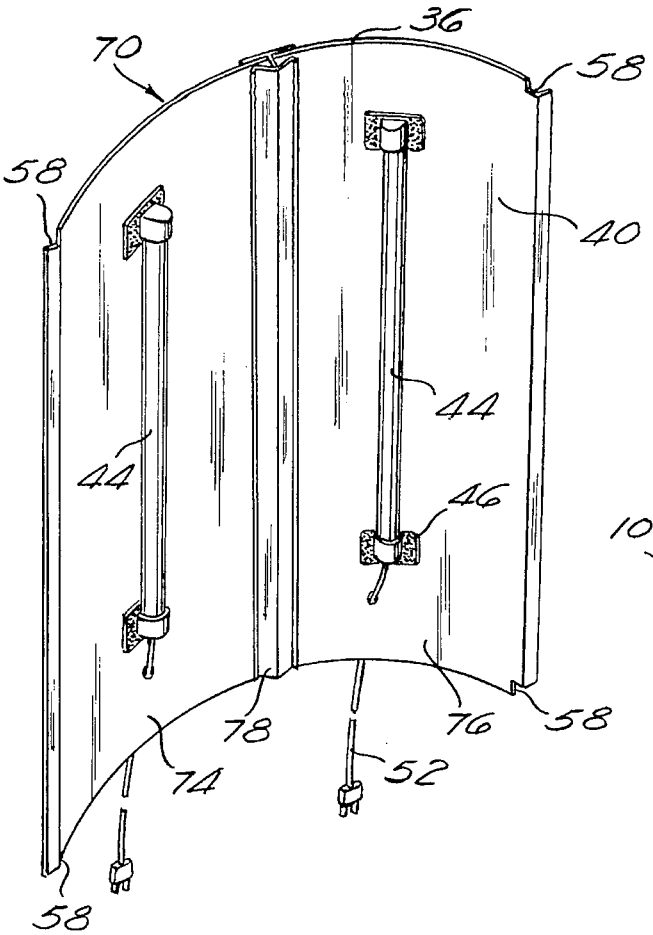
FIG. 11 is a front perspective view of the second embodiment of the backlighting light fixture of the invention of FIG. 10.

Referring to FIGS. 6, 9, and 11, the reflector and lamp support portion 32 preferably has notched corners 58 to clear internal corners 60 of the assembled frame sections 24. The notched corners 58 permit the reflector and lamp support portion 32 to be sized such that its top and bottom edges 36 and 38, respectively, are lined up with the top of the top rail section 20 and the bottom of the rail section 22. This alignment gives the assembled panels 16 greater stability when standing, since the bottom edge 38 of the reflector and lamp support portion 32 will sit on the floor support surface. It also contributes to the stability of stacked panels, as is shown in FIG. 1. The notches 58 prevent the backlighting light fixture 32 from sliding up or down relative to the framework 24.

In lieu of sliding the lip regions 54 into a channel 56 of a side rail 18, the lip region 54 can alternately be engaged behind the panel of material 28 with clips, or other means (not shown.)

Figure 8:
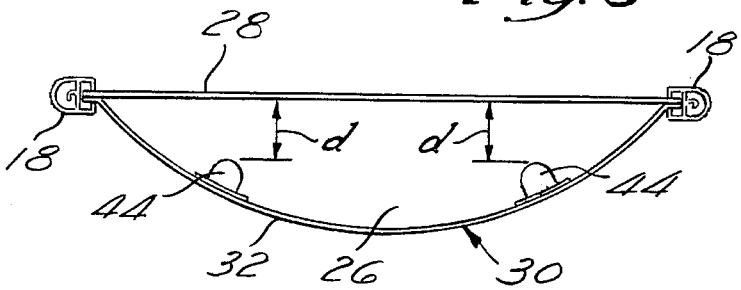
FIG. 8 is a horizontal sectional view of the modular panel section with its affixed backlighting light fixture taken through view lines 8—8 of FIG. 2.

Referring now to FIG. 8, with the backlighting light fixture 32 attached to the framework 24, the light sources 44 will be spaced a distance "d" away from the image bearing panel 28. In versions wherein the panels 16 are 30 inches wide, using a reflector and lamp support portion 32 which is about 34 inches wide in its unbowed state will bow sufficiently such that the light source's 44 spacing away from the rear surface of the image bearing panel 28 "d" is about six inches. This spacing is far enough such that two spaced apart fluorescent bulbs 44 will disperse their light evenly through the image bearing panel 28. By using a slightly wider reflector and lamp support portion 32, the spacing "d" can be increased, if desired.

Figure 10:
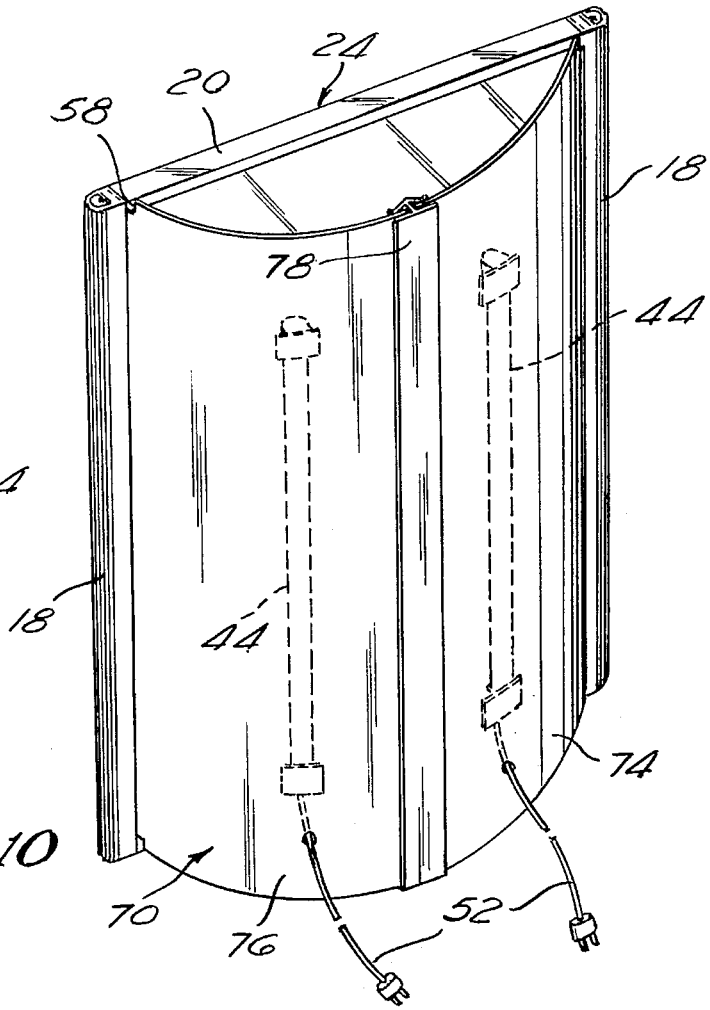
FIG. 10 is a rear perspective view of one modular panel section of the trade show and presentation display structure with a second embodiment of a backlighting light fixture of the invention affixed thereto.
Figure 12:
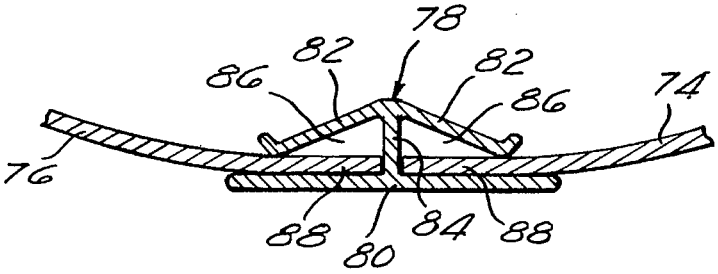
FIG. 12 is a sectional view showing a splice joiner for joining two sections of the reflector and lamp support portion of the backlighting light fixture of FIG. 10.

Referring now to FIGS. 10–12, a second embodiment of the backlighting light fixture 70 is shown. In this embodiment, rather than utilizing a single sheet of material to form a reflector and lamp support portion, two reflector and lamp support sections 74 and 76 are joined together along a vertical line by a splice joiner member 78. The splice joiner member 78 has a back wall 80, front walls 82, and a divider 84, defining two channels 86 into which vertical inside edge regions 88 of the reflector and lamp support sections 74 and 76 are placed. The advantage of this second embodiment 70 of the backlighting light fixture is that since the two reflector and lamp support sections 74 and 76 are narrower than the width of the framework 24 of the panel 16 to which it attaches, the two reflector and lamp support sections 74 and 76 can be placed in a box exactly sized for the panel sections 16 in a lay flat position without any bending. Other features of backlighting light fixture 70 are the same as the first embodiment.

Figure 13:
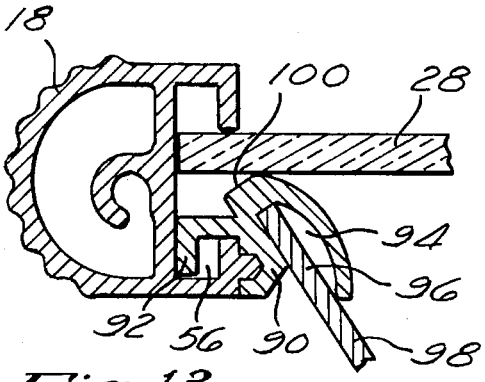
FIG. 13 is sectional view showing an adapter member to permit unbent edges of the reflector and lamp support portion to detachably engage with the rail sections.
Figure 15:
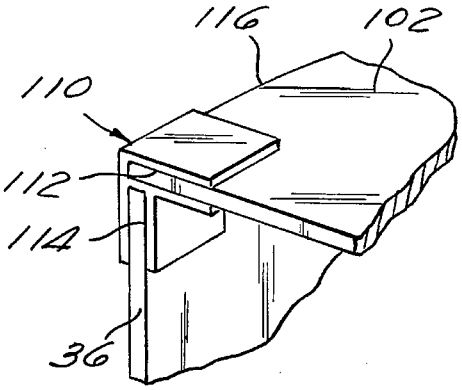
FIG. 15 is a perspective view of an optional joiner clip which is adapted to hold the top cap of FIG. 14 to the reflector and lamp support portion of the backlighting light fixture.

Referring to FIG. 13, an alternate engagement means to detachably engage the backlighting light fixtures 30 and 70 to the panels 16 is shown. In this system, an adapter member 90 is provided. The adapter member 90 has a portion 92 which is adapted to engage with the channel 56 of the side rails 18, and a slot channel 94 which is oriented at an angle adapted to receive unbent side edges 96 of a bowed reflector and lamp support portion 98. With this alternate engagement means, the spring force of the bowed backlighting light fixture's reflector and lamp support portion 98 prevents its unbent side edges 96 from slipping out of the channel 94 of the adapter member 90, and also aids in preventing the adapter member 90 from inadvertently coming out of the channel 56 of the side rail 18. The adapter member 90 can be rolled into the channel 56, and preferably has a edge 100 which pushes the image bearing panel 28 forwardly, to help prevent the panel 28 from shaking or shifting in the framework 24.

Since the backlighting light fixtures 30 and 70 are arcuate when installed, they can be utilized in display structures where complete edge-to-edge backlighting is desired. For example, the backlighting light fixtures 30 and 70 can be used in assembling column structures where adjacent panels, oriented 90 degrees apart, are to be backlit. Using prior art rectangular box-shaped backlighting light fixtures, it is not possible to achieve edge-to-edge lighting of the outside corners of panels assembled into columns.

Figure 14:
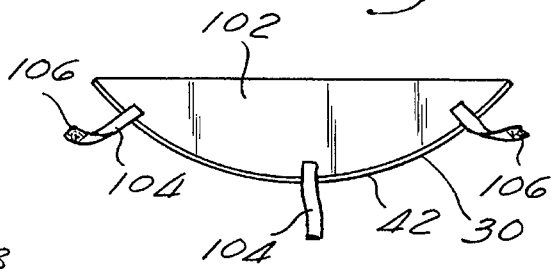
FIG. 14 is a top perspective view of an optional top cap for the backlighting light fixtures of the invention.

Referring to FIG. 14, an optional arcuate top cap 102 which can be detachably placed on top of backlighting light fixtures 30 or 70, to block any incident light from escaping out of its open top. The top cap 104 can be detachably retained above the top edge 36 of the reflector and lamp support portions (see FIG. 4*a*), by straps 104 with patches of hook/or loop material 106, with corresponding hook and loop material 108 placed on the back side 42 of the reflector and lamp support portion 30 (see FIG. 2.) Alternately, clips 110 which have channels 112 and 114 offset at 90 degrees and sized to slideably receive the edge 116 of the top cap 102 and the top edge 36 of the reflector and lamp support portions 32 or 70. For flush mounting, the top cap 102 can also be sized to fit just inside the reflector and lamp support portion 32, just under its top edge 36, with appropriate clip means (not shown).

The backlighting light fixtures 30 and 70 of the invention have been described for use in an environment of vertical panels. The backlighting light fixtures 30 and 70 of the invention are also adapted for use in backlighting of horizontal surfaces, such as horizontal display stands with light translucent tops, such as, photographic light tables, and the like. For these purposes, the light fixtures will be mounted horizontally under a light translucent top. However, in other respects, the backlighting light fixture can be utilized as above-described.

The advantages of the invention over the prior art systems are many. The total weight of the backlighting light fixture of the invention, including two 25 inch long, 33 watt GE "Bright Stick" fluorescent lamps, and their cords, weight less than five pounds, which compares favorably with prior art systems which weigh 15 pounds and more. This far lighter weight makes shipping and handling of the backlighting light fixture easier and less expensive. The installation of the backlighting light fixture of the invention can be made quickly and easily, without tools. Replacing burnt out light bulbs is also easier. The backlighting light fixture of the invention is far more compact to ship since its lights can be detached from the reflector and lamp support portion and the panels and lights will fit into a shipping container occupying much room. The cost of manufacturing the backlighting light fixture is also far less than prior art backlighting light fixtures since it is so simple in design, and can be made so quickly.

The drawings and the foregoing description are not intended to represent the only form of the invention in regard to the details of this construction and manner of operation. The terms "horizontal" and "vertical", "top" and "bottom", and "sides" are not meant to be limitations herein, as the invention will function with the backlighting light fixture being bowed from top to bottom, and being oriented horizontally. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following the claims which follow.

I claim:

1. A backlighting light fixture adapted for use in providing backlight illumination for display structures having a framework comprising rail members assembled to define openings, with translucent panels mounted in the openings, said backlighting light fixture comprising:

a reflector and lamp support portion comprising resilient and flexible material, having an inside surface, an outside surface, and opposing side edges and top and bottom edges;

first attachment means fixed to said inside surface of said reflector and lamp support portion;

at least one light source;

a second attachment means fixed to said at least one light source, said first and second attachment means being detachably attachable together so that said at least one light source detachably affixes to said inside surface of said reflector and lamp support portion;

wherein said backlighting light fixture is detachably engageable with said display structure by rearwardly bowing the outside surface of said reflector and lamp support portion carrying said at least one light source, and engaging said side edges of said reflector and lamp support portion with the display structures so that said reflector and lamp support portion and the affixed at least one light source are securely retained in an area of one of the openings.

2. The backlighting light fixture adapted for use in providing backlight illumination for display structures of claim 1, wherein said reflector and lamp support portion comprises a sheet of opaque, expanded polyvinyl chloride.

3. The backlighting light fixture adapted for use in providing backlight illumination for display structures of claim 1, wherein said first and second attachment means comprise complementary sections of hook and loop material.

4. The backlighting light fixture adapted for use in providing backlight illumination for display structures of claim 1, wherein said at least one light source comprises strip fluorescent lamp fixtures.

5. The backlighting light fixture adapted for use in providing backlight illumination for display structures of claim 1, wherein said reflector and lamp support portion has an aperture formed therethrough for passage of an electric cord to power said at least one light source.

6. The backlighting system adapted for use in providing backlight illumination for display structures of claim 1, wherein said side edges of said reflector and lamp support portion are bent rearwardly to define lip regions, and said lip regions are detachably engaged with the rail members of the display structure.

7. The backlighting system adapted for use in providing backlight illumination for display structures of claim 1, wherein said reflector and lamp support portion has notched corners.

8. The backlighting system adapted for use in providing backlight illumination for display structures of claim 1, further comprising adapter members which are detachably engageable with said rails, said adapter members having a channel which is oriented at an angle adapted to receive unbent side edges of said reflector and lamp support portion, wherein a spring force of said bowed reflector and lamp support portion securely, yet detachably, retains said reflector and lamp support portion in said adapter member and said adapter member in the rails.

9. The backlighting system adapted for use in providing backlight illumination for display structures of claim 1, wherein said reflector and lamp portion comprises a plurality of sections of material held together by a splice member.

10. A backlighting light fixture adapted for use in providing backlight illumination for display structures, the display structures comprising a framework of side rail means and top and bottom rail means assembled to define openings, the rail means having channels formed along their inside regions, and translucent panels with a perimeter region, the panels being mountable within the openings of the framework by placing the perimeter region of the panels in the channels of the rail means, said backlighting system comprising:

a reflector and lamp support portion comprising flexible and resilient material, having an inside surface, an outside surface, opposing side edges and top and bottom edges;

first attachment means fixed to said inside surface of said reflector and lamp support portion;

at least one light source;

a second attachment means fixed to said at least one light source, said first and second attachment means being detachably attachable together so that said at least one light source detachably affixes to said inside surface of said reflector and lamp support portion;

wherein said backlighting light fixture is detachably engageable with said display structure by bowing rearwardly the outside surface of said reflector and lamp support portion carrying said at least one light source, and engaging said side edges of said reflector and lamp support portion with the rail means so that said reflector and lamp support portion and the affixed at least one light source are securely retained in an area of one of the openings.

11. The backlighting light fixture adapted for use in providing backlight illumination for display structures of claim 10, wherein said reflector and lamp support portion comprises a sheet of opaque, expanded polyvinyl chloride.

12. The backlighting light fixture adapted for use in providing backlight illumination for display structures of claim 10, wherein said reflector and lamp support portion has corners which are notched out so that when said reflector and lamp support portion and its at least one light source are placed within said framework, said top and bottom edges of said reflector and lamp support portion will generally line up with the top and bottom rail members, respectively, of the display structure's framework.

13. The backlighting light fixture adapted for use in providing backlight illumination for display structures of claim 10, wherein said first and second attachment means comprise complementary sections of hook and loop material.

14. The backlighting light fixture adapted for use in providing backlight illumination for display structures of claim 10, wherein said at least one light source comprises a pair of strip fluorescent lamp fixtures, and said reflector and lamp support portion has apertures formed therethrough for passage of an electric cord to power said fluorescent lamp fixtures.

15. The backlighting light fixture adapted for use in providing backlight illumination for display structures of claim 10, wherein said side edges of said reflector and lamp support portion are bent rearwardly to define lip regions, and said lip regions are detachably engaged within the channels of the rail means of the display structures.

16. The backlighting light fixture adapted for use in providing backlight illumination for display structures of claim 10, further comprising adapter members which are detachably engageable with the channels of the rail means, said adapter members having an angled channel which is oriented at an angle adapted to slideably yet securely receive unbent side edges of said bowed reflector and lamp support portion, wherein a spring force of said bowed reflector and lamp support portion securely, yet detachably, retains said reflector and lamp support portion in said adapter members and said adapter members in the rail means.

17. The backlighting system adapted for use in providing backlight illumination for display structures of claim 10, wherein said reflector and lamp portion comprises a plurality of sections of material held together by a splice member.

* * * * *